US005146653A

United States Patent [19]

Hergeth

[11] Patent Number: 5,146,653

[45] Date of Patent: Sep. 15, 1992

[54] SUCTION CHAMBER

[76] Inventor: Hubert Hergeth, Koenigsmuehlenweg 11, 5100 Aachem, Fed. Rep. of Germany

[21] Appl. No.: 697,696

[22] Filed: May 9, 1991

Related U.S. Application Data

[63] Continuation-in-part of Ser. No. 505,706, Apr. 5, 1990, abandoned.

[30] Foreign Application Priority Data

Apr. 17, 1989 [DE] Fed. Rep. of Germany ..... 3912529

[51] Int. Cl.[5] ..... D01B 3/00

[52] U.S. Cl. ..... 19/205; 19/200

[58] Field of Search ..... 19/98, 99, 106 R, 200, 19/203, 204, 205, 304

[56] References Cited

U.S. PATENT DOCUMENTS

| | | | |
|---|---|---|---|
| 3,204,296 | 9/1965 | Reiterer | 19/106 R |
| 3,528,138 | 9/1970 | Elder | 19/203 |
| 4,224,720 | 9/1980 | Morgner et al. | 19/204 |
| 4,507,827 | 4/1985 | Staehli | 19/203 |
| 5,007,137 | 4/1991 | Graute | 19/304 |

FOREIGN PATENT DOCUMENTS 255941 7/1967 Fed. Rep. of Germany .

*Primary Examiner*—Werner H. Schroeder
*Assistant Examiner*—Michael A. Neas
*Attorney, Agent, or Firm*—Michael J. Striker

[57] ABSTRACT

A suction chamber for machines for opening and cleaning textile fibers is subdivided into at least two parts. One part of the chamber is mounted swivelably relative to the other part. Therefore, a drum of the machine and the suction chamber become easily accessible.

6 Claims, 1 Drawing Sheet

SUCTION CHAMBER

CROSS-REFERENCE TO RELATED APPLICATIONS

This application is a continuation-in-part of U.S patent application Ser. No. 505,706, filed on Apr. 5, 1990, now abandoned.

BACKGROUND OF THE INVENTION

The present invention relates to a suction chamber for removing fibres from a drum of a textile fiber opening or cleaning machine.

The fibers are normally fed to these machines by a transport band, and opened by at least one roller provided with spikes. Any cleaning of the fibers is done by means of a grid located underneath the roller. Thereafter, the fibers are removed by an air current brushing the circumference of the drum and sucked off by a suction funnel. In order to promote lifting of the fibers from the spikes, it is necesary to provide at the end of the suction chamber—seen in the circumferential direction—a limiting face and, better, in addition, a knife set closely on the spikes. After the suction chamber, the drum is covered by an air screen or a trough. This serves, should some fibers pass the suction zone, to convey the latter along with the drum and not to let them be flung unhindered into the machine. These limiting faces or knives are normally fastened to transverse arms. In order to arise the heavy drum up or to inspect the suction chamber, these transverse arms must be laboriously dismantled and later precisely reinstalled.

A cleaning machine is known in which the air screen, knife, suction chamber and suction funnel are rigidly connected and can be swiveled about a fulcrum on the suction side of the machines, in order to gain access to the drum. A disadvantage of this known machine is that it is necessary to disconnect the pipeline following the suction funnel in order to swivel the unit. For disconnecting the pipeline, it is necessary to support the pipeline separately.

SUMMARY OF THE INVENTION

It is the object of the invention to provide a covering of the roller, a limiting face and a suction chamber which enable the drum to be laid open simply and widely, without it being necessary for the suction lines to be disconnected.

According to the invention the suction chamber is divided into a swivelable part with an air screen and a limiting face, the fulcrum being located on the side where the fiber is drawn in, and a stationary part with an inlet of a suction funnel.

Due to this division, it is possible to guarantee simple access to the drum. It is possible in this way to displace the drum upwards without dismantling parts and, at the same time, to inspect and service the suction chamber. The suction funnel and the suction line remain connected to the machine. Since the suction line is not disconnected, it need not be supported by additional frames.

BRIEF DESCRIPTION OF THE DRAWINGS

The invention will be described in more detail in accordance with the drawings.

DESCRIPTION OF THE PREFERRED EMBODIMENTS

Figure 1:
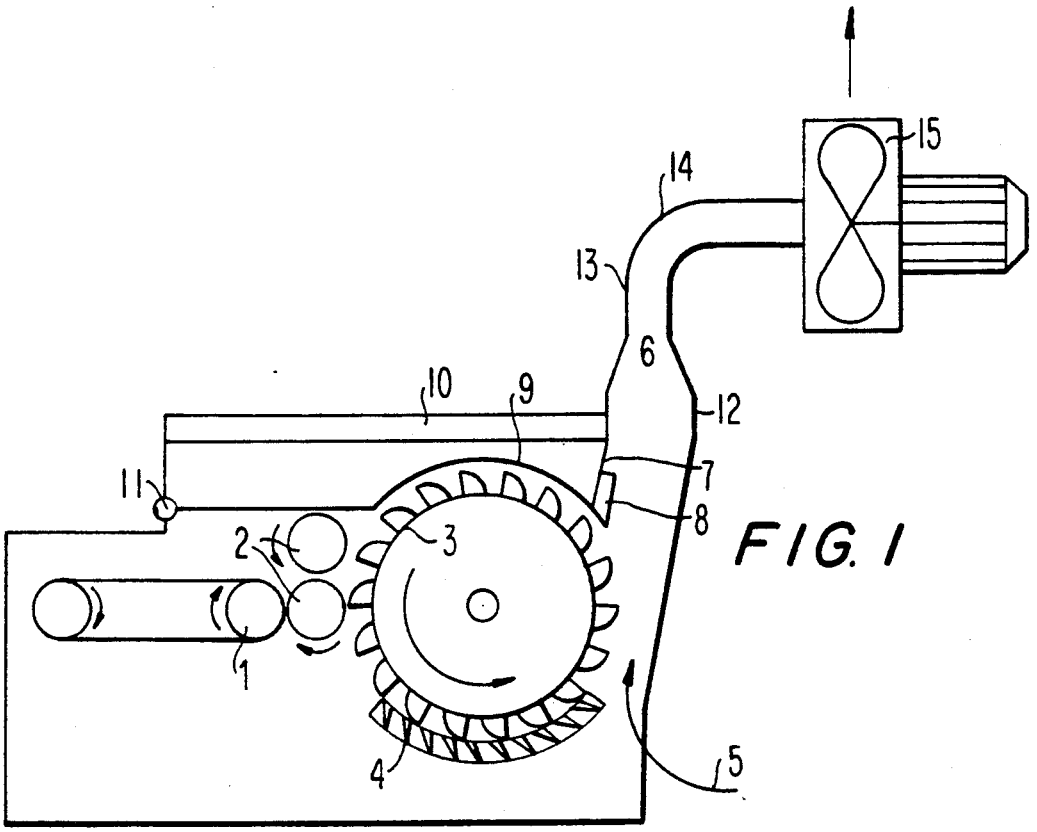
FIG. 1 shows a textile fiber opening machine with a suction chamber in accordance with the present invention in cross-section.
Figure 2:
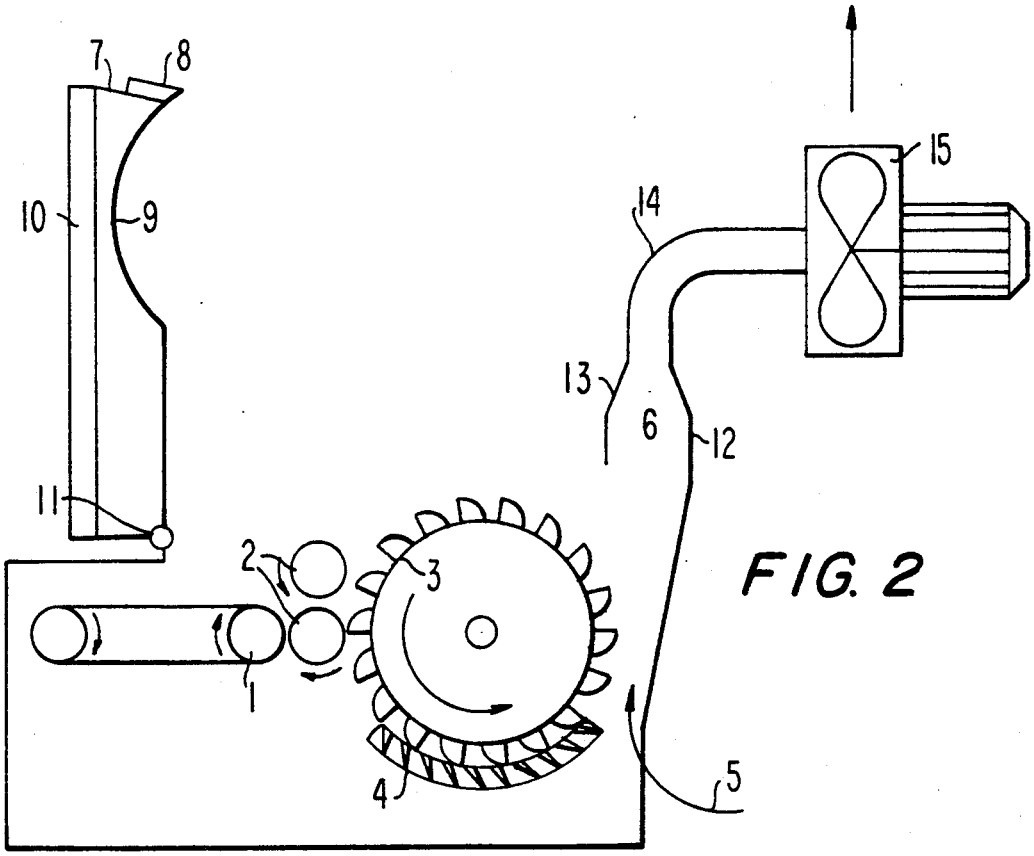
FIG. 2 shows the machine with the inventive suction chamber in the opened state.

A textile fiber opening or cleaning machine is schematically shown in the drawings. The machine includes a transport device 1 in a form of a conveyor belt and a fiber separating device comprising an opening drum or roller 3 associated with a trough 4. At the entrance of the separating device, there are arranged two feed rollers 2 which press the fibers and feed them to the opening roller 3. The roller 3 is covered with pins or sawtooth wire. The trough 4 is a metal baffle located beneath the opening roller 3 to prevent dropping the fibers off the roller 3. The roller 3 is further associated with a suction chamber 6 into which the fibers pass from the opening roller 3. The suction chamber 6 has opposite walls 7 and 12. A knife is mounted on the wall 7 adjacent to the opening roller 3 and extends radially to the roller 3 closely to the apexes of the pins or wire points. The machine further includes a screen cover 9 for the opening 3. The screen cover 9 is fixedly connected with the wall 7 and with the machine cover 10. The wall 7, the screen cover 9, and the machine cover 10 together pivot about fulcrum 11. The screen cover 9 serves for guiding fibers that pass the knife 8 back onto the opening roller 3. The wall 12 of the suction chamber 6 is fixedly secured to the machine frame so that pivotal movement of the wall 7 together with covers 9 and 10, provides for easy access to the opening roller and the suction chamber, as shown in FIG. 2 The suction chamber ends with a funnel 13 connected to a suction conduit 14 which in turn is connected with suction source 15.

The operation of the textile fiber opening or cleaning machine should be clear from the foregoing description thereof. Nevertheless, a short description of its operation will be given below. The conveyor belt 1 delivers fibers to rollers 2 that press them and feed to the opening roller 3. The fibers are carried on the apexes of the pins or wire points by the roller. An air stream 5 collects the fibers from the opening roller 3 and carries them into the suction chamber 6. The knife 8 serves for cutting the air stream off and directing it upward to the funnel 13. The air stream will pick the fibers from the roller 3 when the speed of the air stream is greater than that of the roller 3. The knife 8 acts as a cliff in the sea with the waves running up.

It will be understood that each of the elements described above, or two or more together, may also find a useful application in other types of constructions differing from the types described above.

While the invention has been illustrated and described as embodied in a suction chamber for removing fibers from a drum of a textile fiber opening or cleaning machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A suction chamber for removing fibers from an opening roller of textile fiber opening and cleaning machines, said suction chamber comprising wall means defining a suction space; an air screen superimposable over the opening roller, said wall means including a stationary wall having an outlet for connection to a suction source, and a wall portion pivotable relative to said stationary wall, said wall portion having a limiting face and being connected to said air screen for joint pivotal movement therewith; and pivot means for pivoting said wall portion together with said air screen.

2. A suction chamber as set forth in claim 1, wherein the machine has a feeding side and the opening roller has an axis, said wall portion being pivotable about a fulcrum located above the axis of the opening roller and in a region of the feeding side of the machine.

3. A suction chamber as set forth in claim 1, further comprising a suction conduit connected to said outlet; and means for connecting said suction conduit to said outlet so that said suction conduit remains connected to said outlet during pivotal movement of said wall portion to an opening position of said wall portion.

4. A suction chamber as set forth in claim 3, wherein said connecting means include a funnel connecting said outlet and said suction conduit.

5. A suction chamber as set forth in claim 1, wherein said stationary wall and said wall portion rest against each other along a line located on a machine side of said suction chamber.

6. A suction chamber for removing fibers from an opening roller of textile fiber opening and cleaning, machines said suction chamber comprising wall means defining a suction space; an air screen, said wall means including a stationary wall having an outlet for connection to a suction source, and a wall portion pivotable relative to said stationary wall, said wall portion having a limiting face, and a knife provided on said limiting face, and said wall portion being connected to said air screen for joint pivotal movement therewith; and pivot means for pivoting said wall portion together with said air screen.

* * * * *